US009792879B2

(12) United States Patent
Lin

(10) Patent No.: US 9,792,879 B2
(45) Date of Patent: Oct. 17, 2017

(54) DISPLAY SYSTEM AND DRIVING METHOD

(71) Applicant: HIMAX TECHNOLOGIES LIMITED, Tainan (TW)

(72) Inventor: Chih-Feng Lin, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 85 days.

(21) Appl. No.: 14/961,907

(22) Filed: Dec. 8, 2015

(65) Prior Publication Data

US 2017/0162170 A1 Jun. 8, 2017

(51) Int. Cl.
*G09G 5/02* (2006.01)

(52) U.S. Cl.
CPC ..... *G09G 5/02* (2013.01); *G09G 2300/0452* (2013.01); *G09G 2320/0261* (2013.01); *G09G 2330/021* (2013.01)

(58) Field of Classification Search
CPC ..... G09G 5/02; G09G 2300/0452; G09G 2320/0261; G09G 2330/021
See application file for complete search history.

(56) References Cited

U.S. PATENT DOCUMENTS

2007/0103487 A1 5/2007 Watson et al.
2009/0128666 A1* 5/2009 Rappaport ..... G06T 5/20 348/241
2010/0103274 A1 4/2010 Kim
2013/0229395 A1* 9/2013 Mills ..... H04N 5/367 345/207
2014/0225816 A1* 8/2014 Shi ..... G02B 26/0833 345/84

FOREIGN PATENT DOCUMENTS

| | | | |
|---|---|---|---|
| CN | 102685406 | A | 9/2012 |
| CN | 104067611 | A | 9/2014 |
| TW | I395468 | B | 5/2013 |
| TW | I398825 | B | 6/2013 |
| TW | I399085 | B | 6/2013 |
| TW | 201536053 | A | 9/2015 |

* cited by examiner

*Primary Examiner* — MD Saiful A Siddiqui
(74) *Attorney, Agent, or Firm* — CKC & Partners Co., Ltd.

(57) ABSTRACT

A display system that includes a display panel and a display device is provided. The display panel has display pixels each of the display pixels including two sub display pixels. The driving device includes a mode detection unit, a 1-D sub-pixel rendering unit and a 2-D sub-pixel rendering unit. The mode detection unit determines whether a predetermined condition of the first frame is met. The 1-D sub-pixel rendering unit generates first display pixel values when the predetermined condition is not met. The 2-D sub-pixel rendering unit generates second display pixel values when the predetermined condition is met. Either the first display pixel values or the second display pixel values are generated to be outputted to the display panel and are displayed by the display pixels.

16 Claims, 7 Drawing Sheets

DISPLAY SYSTEM AND DRIVING METHOD

BACKGROUND

Field of Invention

The present disclosure relates to a display system. More particularly, the present disclosure relates to an arrangement for sub-pixels of the display system.

Description of Related Art

Display devices are commonly used in a variety of electronic products. Pixels of a display panel are divided into three sub-pixels, and thus each of the sub-pixels can be driven individually.

However, as the development of the resolution of the display panel, the size of the sub-pixels is limited. As a result, an aperture ratio is reduced, and a difficulty of manufacture is increased.

SUMMARY

An aspect of the present invention is to provide a display system. The display system includes a display panel and a display device. The display panel has a plurality of display pixels arranged in display rows and display columns, each of the display pixels includes two sub display pixels arranged along a row direction such that any three of the consecutive sub display pixels in either the row direction and a column direction display a combination of a first color, a second color and a third color. The driving device includes a mode detection unit, a one dimensional (1-D) sub-pixel rendering unit and a two dimensional (2-D) sub-pixel rendering unit. The mode detection unit receives a first frame from a video source and to determine whether a predetermined condition of the first frame is met. The one dimensional (1-D) sub-pixel rendering unit receives a second frame having a plurality of data pixels arranged in data rows and data columns from the video source and to generate a plurality groups of first display pixel values each generated for one target data pixel based on the neighboring data pixels within a same one of the data rows when the predetermined condition is not met. The two dimensional sub-pixel rendering unit receives the second frame from the video source and to generate a plurality groups of second display pixel values each generated for one target data pixel based on surrounding data pixels in the neighboring data rows and the neighboring data columns when the predetermined condition is met. Either the groups of the first display pixel values or the groups of the second display pixel values are generated to be outputted to the display panel and are displayed by the display pixels.

Yet another aspect of the present invention is to provide a driving method used in a display system. The driving method includes the steps outlined below. A display panel having a plurality of display pixels arranged in display rows and display columns is provided, each of the display pixels includes two sub display pixels arranged along a row direction such that any three of the consecutive sub display pixels in either the row direction and a column direction display a combination of a first color, a second color and a third color. A first frame is received from a video source and whether a predetermined condition of the first frame is met is determined. A second frame having a plurality of data pixels arranged in data rows and data columns from the video source is received by a one dimensional sub-pixel rendering unit to generate a plurality groups of first display pixel values each generated for one target data pixel based on the neighboring data pixels within a same one of the data rows when the predetermined condition is not met. The second frame from the video source is received by a two dimensional sub-pixel rendering unit to generate a plurality groups of second display pixel values each generated for one target data pixel based on surrounding data pixels in the neighboring data rows and the neighboring data columns when the predetermined condition is met. Either the groups of the first display pixel values or the groups of the second display pixel values is generated and outputted to be displayed by the display pixels of the display panel.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
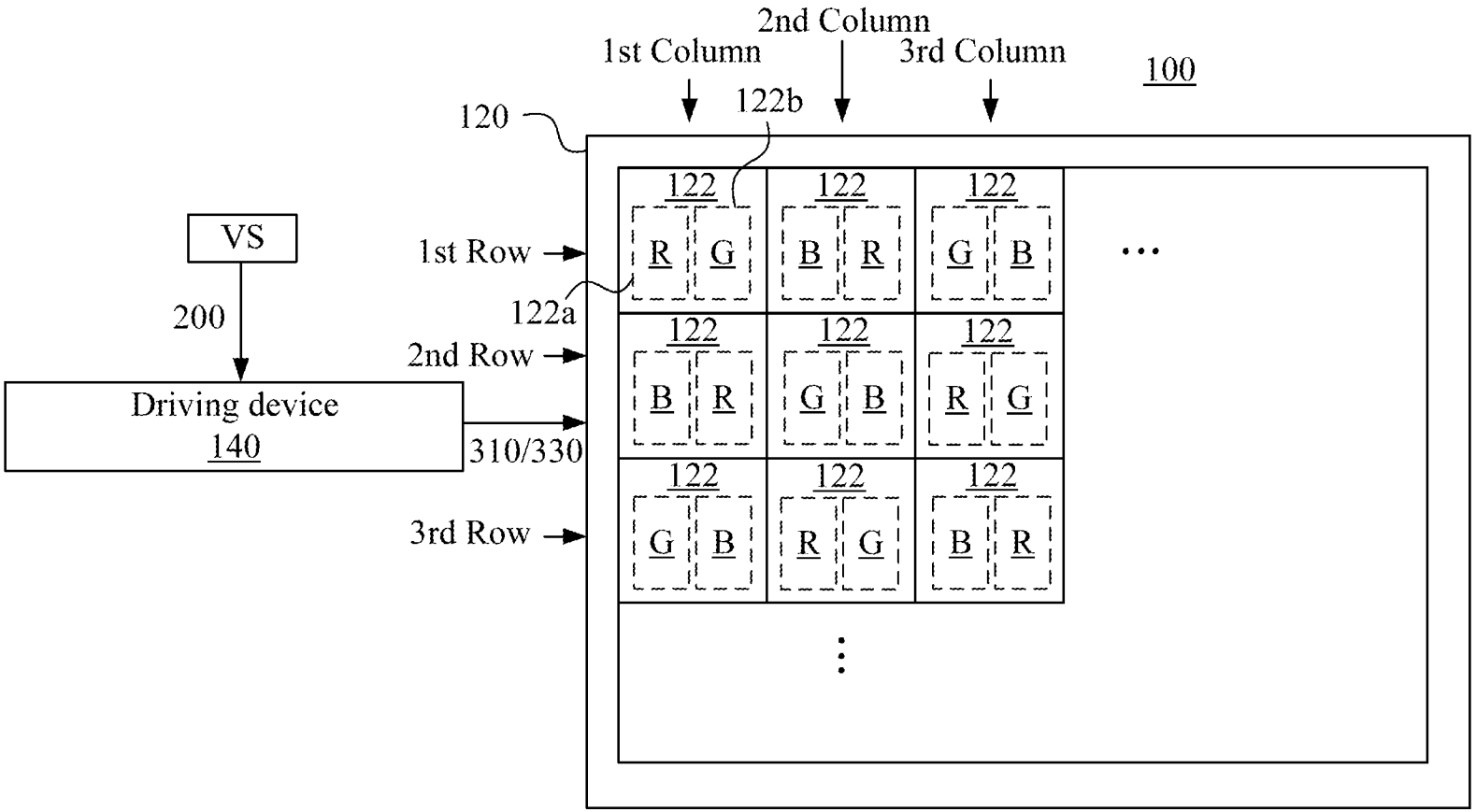
FIG. 1 is a block diagram of a display system in accordance with various embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is now made to FIG. 1. FIG. 1 is a block diagram of a display system 100 in accordance with various embodiments of the present disclosure. The display system 100 includes a display panel 120 and a driving device 140.

The display panel 120 includes display pixels 122. The display pixels 122 are arranged in row and columns. Each of the display pixels 122 includes a sub-pixel 122*a* and a sub-pixel 122*b*, and the sub-pixel 122*a* and the sub-pixel 122*b* are arranged along a row direction.

In the present embodiment, any three of the consecutive sub display pixels in either the row direction and the column direction display a combination of a first color, a second color and a third color, e.g. the colors of red, green and blue.

For example, as illustrated in FIG. 1, the display pixel 122 disposed at the first row and the first column includes the sub-pixel 122*a* and the sub-pixel 122*b* to display the colors of red and green respectively. The display pixel 122 disposed at the first row and the second column includes the sub-pixel 122*a* and the sub-pixel 122*b* to display the colors of blue and red respectively. Moreover, the sub-pixels 122*a* included in the display pixels 122 disposed at the second row and the third row display the colors of blue and green respectively.

It is appreciated that in other embodiments, the order of the colors can be different and is not limited thereto.

The driving device 140 is coupled to the display panel 120, and is configured to drive the display panel 120. In some embodiments, the driving device 140 is configured to determine pixel values of the sub-pixel 122*a* and the sub-pixel 122*b* of each of the pixels 122 in accordance with the signals from the video source VS.

Figure 2:
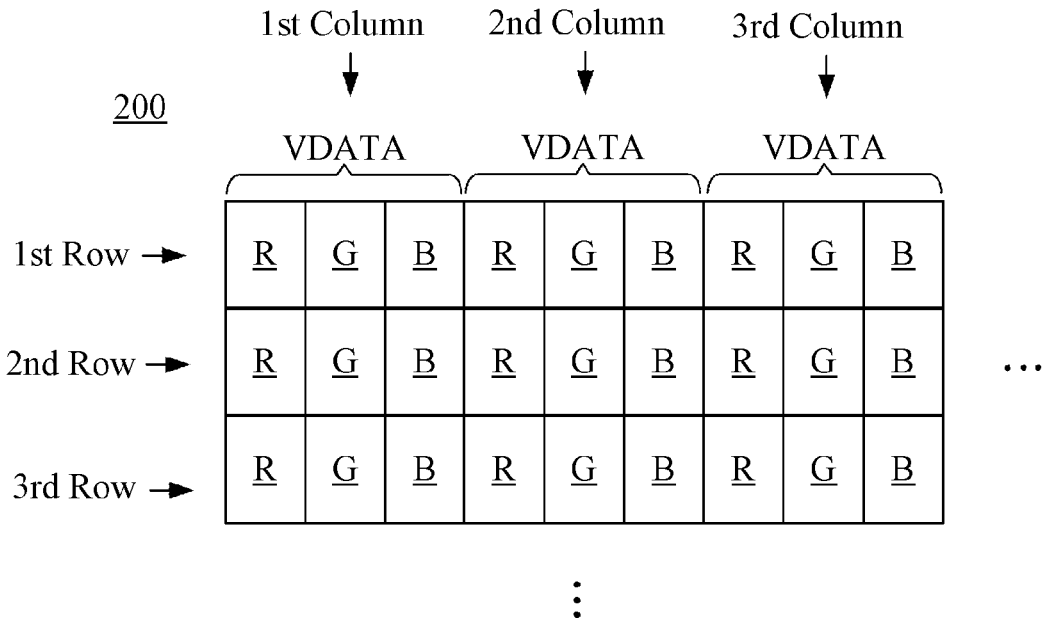
FIG. 2 is a schematic diagram illustrating arrangements of data values of a frame of the signals from the video source shown in FIG. 1, in accordance with various embodiments of the present disclosure.

Reference is made to FIG. 2. FIG. 2 is a schematic diagram illustrating arrangements of data values of a frame 200 of the signals from the video source VS shown in FIG. 1, in accordance with various embodiments of the present disclosure.

As shown in FIG. 2, the frame 200 is provided to drive the each of the rows of the display pixels 122, in which the frame 200 includes image data VDATA. Each of the image data VDATA includes color data values R, G, and B. The color data value R is indicative of a data pixel value for displaying red. The color data value G is indicative of a data pixel value for displaying green. The color data value B is indicative of a data pixel value for displaying blue. In some approaches, each of the image data VDATA is able to drive the pixel having three sub-pixels.

Figure 3:
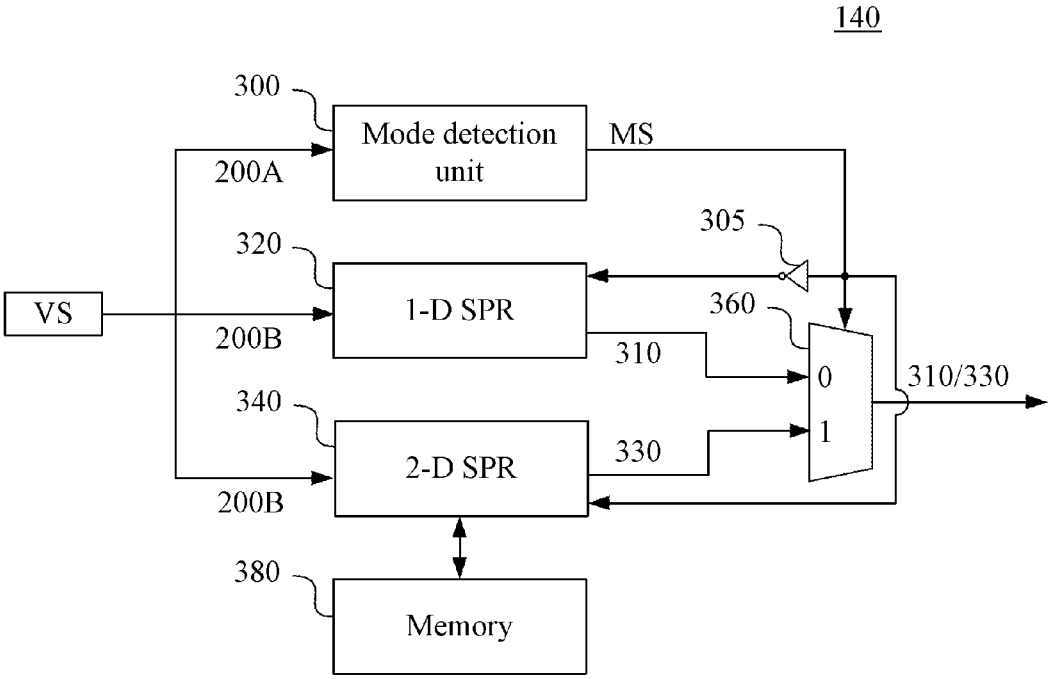
FIG. 3 is a block diagram of the driving device in accordance with various embodiments of the present disclosure.

Reference is now made to FIG. 3. FIG. 3 is a block diagram of the driving device 140 in accordance with various embodiments of the present disclosure. The driving device 140 includes a mode detection unit 300, a one dimensional (1-D) sub-pixel rendering unit 320 and a two dimensional (2-D) sub-pixel rendering unit 340. In FIG. 3, the one dimensional sub-pixel rendering unit 320 and the two dimensional sub-pixel rendering unit 340 are illustrated as 1-D SPR and 2-D SPR respectively.

The mode detection unit 300 is configured to receive a first frame 200A from the video source VS. The mode detection unit 300 further determines whether a predetermined condition of the first frame 200A is met.

In an embodiment, the arrangement of the first frame 200A is identical to the frame 200 illustrated in FIG. 2. The predetermined condition includes a first condition that a number of the pieces of image data VDATA determined to be artificial is larger than a predetermined value.

In an embodiment, one piece of the image data VDATA that includes the color data values R, G, and B is determined to be artificial when all of the color differences between any two of the color values of the piece of the pixel data is larger than or smaller than a predetermined range.

For example, when the color data values R, G, and B are 100, 101 and 102, and the predetermined range is 30-225, the color differences between any two of the color data values R, G, and B are 1, 1, and 2. As a result, the mode detection unit 300 determines that the first condition of the first frame 200A is met. In another example, when the color data values R, G, and B are 50, 90 and 100, and the predetermined range is 30-225, the color differences between any two of the color data values R, G, and B are 40, 10, and 50. As a result, the mode detection unit 300 determines that the first condition of the first frame 200A is not met.

For example, when a frame is a picture having a white background and a plurality of texts formed in black color, all of the color differences between any two of the color values of all the piece of the pixel data is either larger than or smaller than the predetermined range. The first condition is met such that the mode detection unit 300 determines that such a frame is artificial.

In an embodiment, the predetermined condition includes a second condition that the first frame 200A is determined to be a still image. Various technologies can be used to determine whether the first frame 200A is a still image. For example, a motion detection can be used to compare the first frame 200A and a frame (not illustrated) previous thereto.

Whether the predetermined condition is met depends on different usage scenarios. For example, in an embodiment, the predetermined condition is met when both of the first condition and the second condition are met. In another embodiment, the predetermined condition is met only when the first condition is met regardless of the second condition.

The one dimensional sub-pixel rendering unit 320 receives a second frame 200B having data pixels arranged in data rows and data columns from the video source VS. In an embodiment, the arrangement of the second frame 200B is identical to the frame 200 illustrated in FIG. 2. Further, in an embodiment, the second frame 200B is the frame subsequent to the first frame 200A.

The one dimensional sub-pixel rendering unit 320 generates a plurality groups of first display pixel values 310 each generated for one target data pixel based on the neighboring data pixels within a same one of the data rows when the predetermined condition is not met.

On the other hand, the two dimensional sub-pixel rendering unit 340 receives the second frame 200B from the video source VS and to generate a plurality groups of second display pixel values 330 each generated for one target data pixel based on surrounding data pixels in the neighboring data rows and the neighboring data columns when the predetermined condition is met.

In an embodiment, the mode detection unit 300 is configured to generate a mode selection signal MS to control the one dimensional sub-pixel rendering unit 320 and the two dimensional sub-pixel rendering unit 340.

More specifically, the mode detection unit 300 enables the one dimensional sub-pixel rendering unit 320 and disables the two dimensional sub-pixel rendering unit 340 when the predetermined condition is not met. On the other hand, the mode detection unit 300 enables two dimensional sub-pixel rendering unit 340 and disables the one dimensional sub-pixel rendering unit 320 when the predetermined condition is met.

Further, in an embodiment, the driving device 140 further includes a selection unit 360. The mode detection unit 300 is further configured to control the selection unit 360 by using the mode selection signal MS to transmit the first pixel values 310 from the one dimensional sub-pixel rendering unit 320 to the display panel 120 when the predetermined condition is not met, and to transmit the second pixel values 330 from the two dimensional sub-pixel rendering unit 340 to the display panel 120 when the predetermined condition is met.

As a result, either the groups of the first display pixel values 310 or the groups of the second display pixel values 330 are outputted to the display panel 120 and are displayed by the display pixels 122.

It is appreciated that in FIG. 3, the mode selection signal MS with a low state, i.e. 0, is to enable the one dimensional sub-pixel rendering unit 320 through an inverter 305, disable the two dimensional sub-pixel rendering unit 340 and control the selection unit 360 to transmit the first pixel values 310 from the one dimensional sub-pixel rendering unit 320 to the display panel 120. The mode selection signal MS with a high state, i.e. 1, is to enable the two dimensional sub-pixel rendering unit 320, disable the one dimensional sub-pixel rendering unit 340 through the inverter 305 and control the selection unit 360 to transmit the second pixel values 330 from the two dimensional sub-pixel rendering unit 340 to the display panel 120. However, the present invention is not limited thereto.

Exemplary operations of the one dimensional sub-pixel rendering unit 320 and the two dimensional sub-pixel rendering unit 340 are described in detail in the following paragraphs.

Figure 4:
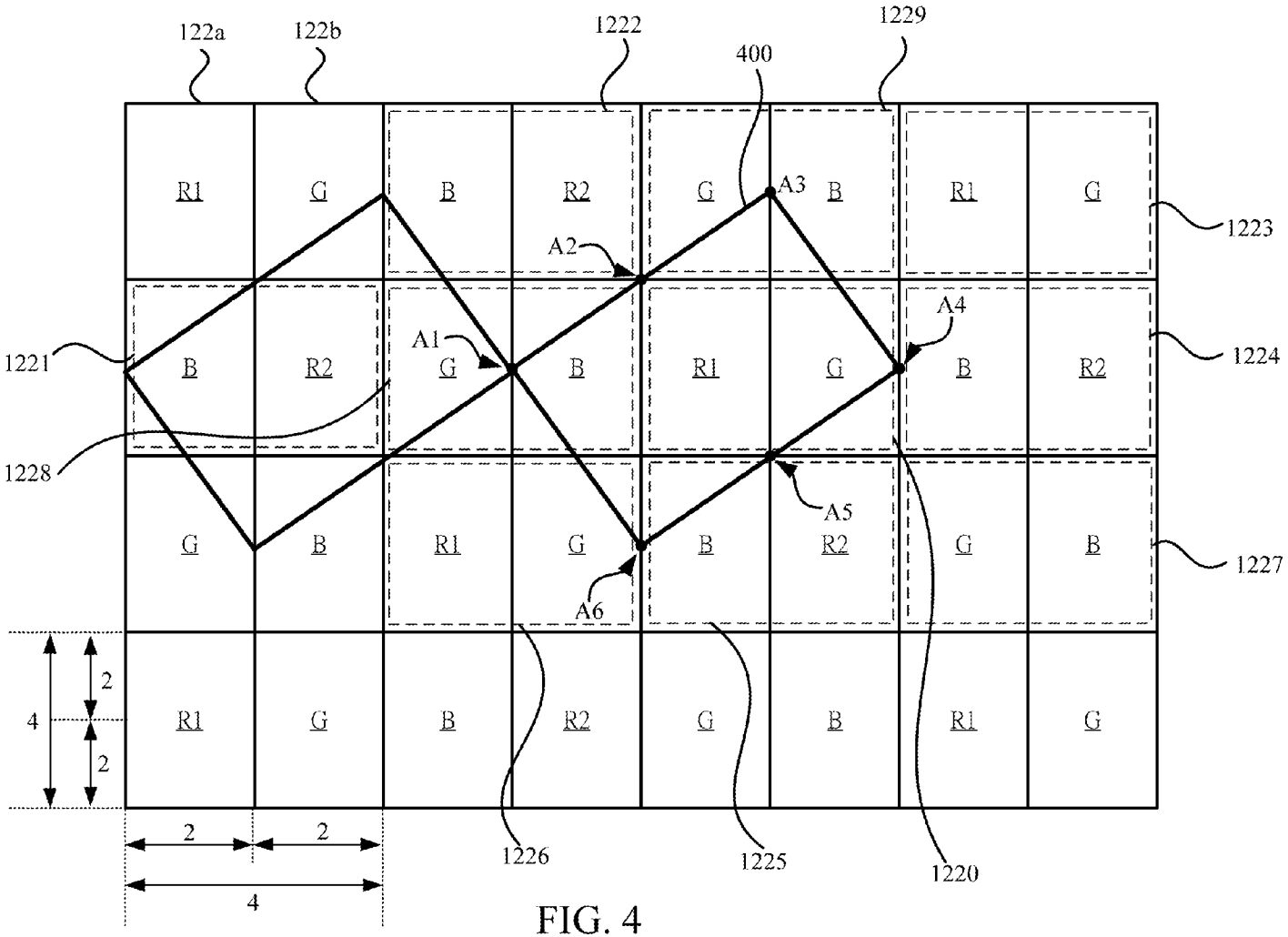
FIG. 4 is a schematic diagram illustrating operations of determining display pixel values, in accordance with various embodiments of the present disclosure.

Reference is made to FIG. 4. FIG. 4 is a schematic diagram illustrating operations of determining display pixel values, in accordance with various embodiments of the present disclosure.

In some embodiments, the two dimensional sub-pixel rendering unit 340 of the driving device 140 is configured to determine the display pixel value of the sub-pixel 122*a* or 122*b* of a corresponding pixel 1220 according to a predetermined region, areas of the predetermine region covered by the pixel 1220 and the pixels 122 around the corresponding pixel 1220, and data values of the color displayed by the sub-pixel 122*a* or 122*b*, corresponding to the pixel 1220 and the pixels 122 around the corresponding pixel 1220 of a frame.

As shown in FIG. 4, the predetermined region 400 has a shape of a parallelogram. Taking the sub-pixel 122*a* of the pixel 1220 as an example, the sub-pixel 122*a* is configured to display red, and the display pixel value of the sub-pixel 122*a* is called as R1 hereinafter. The predetermined region 400 is set by connecting points A1-A6. The point A1 is set to be located at half of a distance between the barycenter position of the sub-pixel 122*a* of the pixel 1220 and the barycenter position of the sub-pixel 122*b*, configured to display red, of the pixel 1221. The point A2 is set to be located at half of a distance between the barycenter position of the sub-pixel 122*a* of the pixel 1220 and the barycenter position of the sub-pixel 122*b*, configured to display red, of the pixel 1222. The point A3 is set to be located at half of a distance between the barycenter position of the sub-pixel 122*b* of the pixel 1222 and the barycenter position of the sub-pixel 122*a*, configured to display red, of the pixel 1223. The point A4 is set to be located at half of a distance between the barycenter position of the sub-pixel 122*a* of the pixel 1220 and the barycenter position of the sub-pixel 122*b*, configured to display red, of the pixel 1224. The point A5 is set to be located at half of a distance between the barycenter position of the sub-pixel 122*a* of the pixel 1220 and the barycenter position of the sub-pixel 122*b*, configured to display red, of the pixel 1225. The point A6 is set to be located at half of a distance between the barycenter position of the sub-pixel 122*a* of the pixel 1226 and the barycenter position of the sub-pixel 122*b*, configured to display red, of the pixel 1225.

In various embodiments, as shown in FIG. 4, sides of each of the pixels 122 are configured to be 4 units of length. In other words, the length of each of the sub-pixel 122*a* and the sub-pixel 122*b* is 2 units of length, and the height of each of the sub-pixel 122*a* and the sub-pixel 122*b* is 4 units of length. As a result, each one of the sub-pixel 122*a* and the sub-pixel 122*b* has an aspect ratio of about 1:2.

The two dimensional sub-pixel rendering unit 340 is able to determine the display pixel value R1 for the sub-pixel 122*a* of the pixel 1220 by calculating areas of the predetermined region 400 covered by the pixel 1220 and the pixels around the pixel 1220, i.e., the pixels 1222-1229. For illustration, the areas of the predetermined region 400 covered by the pixel 1222, the pixel 1223, the pixel 1224, and the pixel 1227 are zero. The area of the predetermined region 400 covered by the pixel 1228 is determined as follows: 8−1−2=5, in which 8 is the area of the sub-pixel 122*b* of the pixel 1228, and 1 and 2 are areas of the two triangular regions, which are not covered by the predetermined region 400, of the sub-pixel 122*b* of the pixel 1228. The area of the predetermined region 400 covered by the pixel 1226 is determined as follows: (½)*1*2=1 (determined by using the formula of the triangular area). Therefore, with the similar calculations, the area of the predetermined region 400 covered by the pixel 1229 is determined as 3, the area of the predetermined region 400 covered by the pixel 1220 is determined as 13, and the area of the predetermined region 400 covered by the pixel 1225 is determined as 2.

Thus, the two dimensional sub-pixel rendering unit 340 is able to determine the display pixel value R1 by using the areas determined above and the data values of red, corresponding to pixel 1220 and the pixels 1222-1229, of the video signal VS. Explained in a different way, the two dimensional sub-pixel rendering unit 340 is configured to determine the display pixel value R1 by calculating weighted coefficients related to the sub-pixel 122*a* of the pixel 1220 from the areas of the predetermined region 400 covered by the pixel 1220 and the pixels 1222-1229. With such configuration, the sub-pixel 122*a* of the pixel 1220 is able to display red as similar as the data values R of the video signal VS.

For illustration, after the areas of the predetermined region 400 covered by the pixels 1220 and 1222-1229 are obtained, the two dimensional sub-pixel rendering unit 340 finds that the weighted coefficients WR1 related to the sub-pixel 122*a* of the pixel 1220 can be determined as an equation (1) below, in which 24 is the area of the predetermined region 400. Thus, the two dimensional sub-pixel rendering unit 340 can generate the display pixel value R1 by using the weighted coefficients WR1 and the data values R, corresponding to the pixel 1220 and 1222-1229, of the video signal VS.

$$WR1 = \begin{bmatrix} 0 & 3 & 0 \\ 5 & 13 & 0 \\ 1 & 2 & 0 \end{bmatrix} \Big/ 24 \tag{1}$$

Similarly, the two dimensional sub-pixel rendering unit 340 is able to determine the display pixel value of the sub-pixel 122*b* (called as R2 hereinafter) of the pixel 1222 with similar operations, and the repetitious descriptions are not given here. The two dimensional sub-pixel rendering unit 340 finds that the weighted coefficients WR2 related to the sub-pixel 122*b* of the pixel 1222 can be determined as an equation (2) below, and the two dimensional sub-pixel rendering unit 340 thus generates the display pixel value R2 by using the weighted coefficients WR2 and the data values R, corresponding to the pixels adjacent to the pixel 1222, of the video signal VS.

$$WR2 = \begin{bmatrix} 0 & 2 & 1 \\ 0 & 13 & 5 \\ 0 & 3 & 0 \end{bmatrix} \Big/ 24 \tag{2}$$

In some ways, the weighted coefficients WR1 are able to be the weighted coefficients for the sub-pixel 122*b* of each of the pixels 122, and the weighted coefficients WR2 are able to be the weighted coefficients for the sub-pixel 122*a* of each of the pixels 122. In other words, in some embodiments, the two dimensional sub-pixel rendering unit 340 is able to calculate the weighted coefficients WR1 and the weighted coefficients WR2 for once, and thus the two dimensional sub-pixel rendering unit 340 is able to determine all of the display pixel values for each of the sub-pixels 122*a* and the sub-pixels 122*b* according to the weighted coefficients WR1, the weighted coefficients WR2, and the data values of the corresponding color of the frame. Thus, a better display quality can be obtained.

It is appreciated that in an embodiment, the second frame 200 is received in a row-by-row manner from the video source VS. As a result, since the operation of the two dimensional sub-pixel rendering unit 340 requires the data pixels within a plurality of rows, a memory 380 is disposed in the driving device 140 to store the data pixels of several rows.

Figure 5:
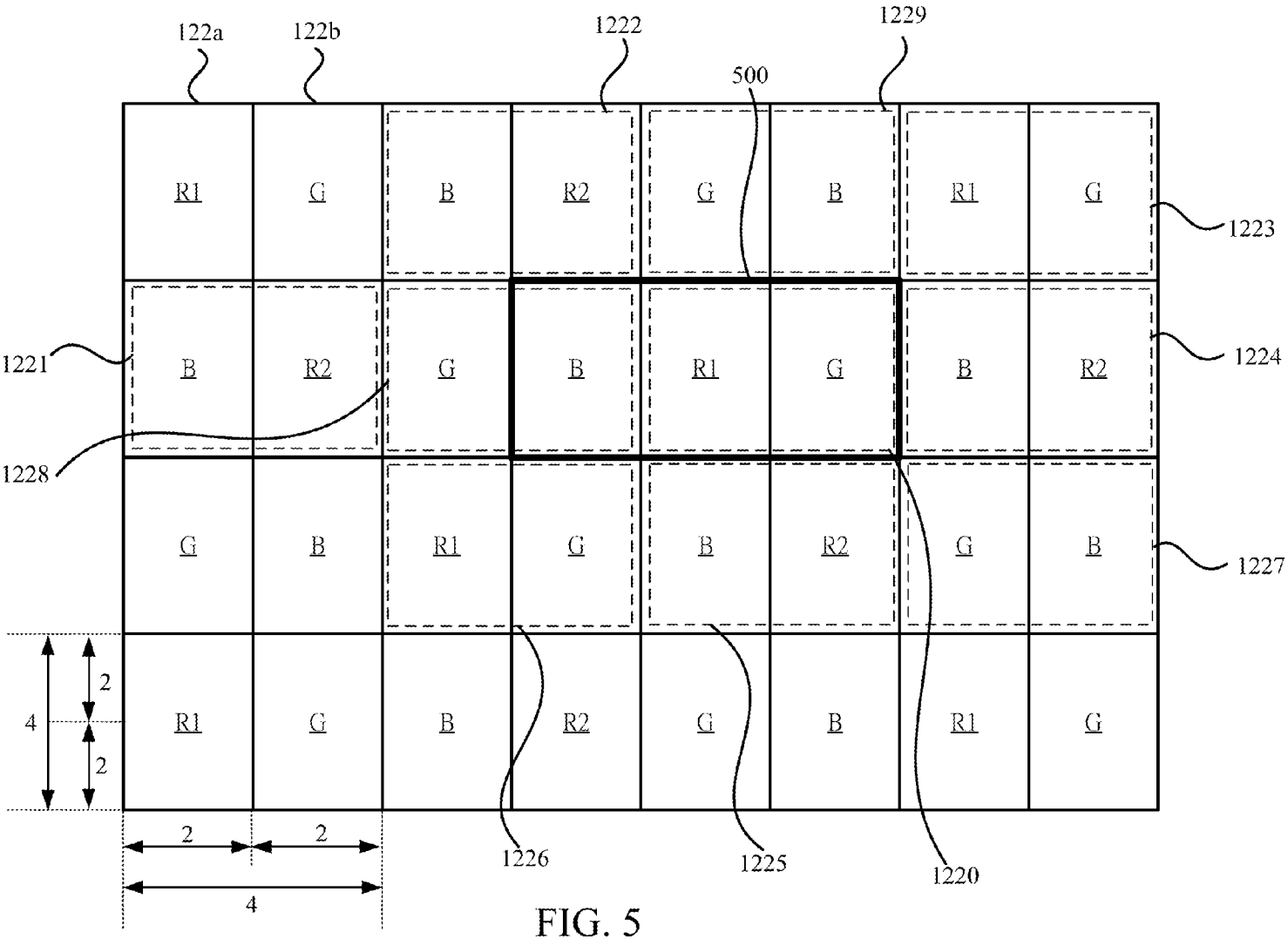
FIG. 5 is a schematic diagram illustrating operations of determining display pixel values, in accordance with various embodiments of the present disclosure.

Reference is made to FIG. 5. FIG. 5 is a schematic diagram illustrating operations of determining display pixel values, in accordance with various embodiments of the present disclosure.

Compared with FIG. 4, the one dimensional sub-pixel rendering unit 320 of the driving device 140 is configured to determine the display pixel value R1 of the sub-pixel 122*a* of the pixel 1220 according to a predetermined region 500, areas of the predetermine region 500 covered by the pixels 1228 and 1224, which are disposed at left side and at right side of the pixel 1220, and data values of red, corresponding to the pixels 1220, 1228 and 1224, of the video signal VS.

As shown in FIG. 5, the predetermined region 500 has a rectangular shape. Similarly, the predetermined region 500 is set based on the barycenter position of the sub-pixel 122*a* of the pixel 1220, the barycenter position of sub-pixel 122*b*, configured to display red, of the pixel 1221, and the barycenter position of the sub-pixel 122*b*, configured to display red, of the pixel 1224.

The one dimensional sub-pixel rendering unit 320 is able to determine the display pixel value R1 for the sub-pixel 122*a* of the pixel 1220 by calculating areas of the predetermined region 500 covered by the pixels 1220, 1228 and 1224. For illustration, the areas of the predetermined region 500 covered by the pixel 1228 is determined as follows: 4*2=8. The area of the predetermined region 500 covered by the pixel 1220 is determined as follows: 8+8=16. The area of the predetermined region 500 covered by the pixel 1224 is 0.

Thus, in this embodiment, the one dimensional sub-pixel rendering unit 320 is configured to determine the display pixel value R1 by calculating weighted coefficients WR1 related to the sub-pixel 122*a* of the pixel 1220 from the areas of the predetermined region 500 covered by the pixel 1220, the pixel 1228 at left side of the pixel 1220, and the pixel 1224 at right side of the pixel 1220. For illustration, after the areas of the predetermined region 500 covered by the pixels 1220, 1228 and 1224, the one dimensional sub-pixel rendering unit 320 finds that the weighted coefficients WR1 related to the sub-pixel 122*a* of the pixel 1220 can be determined as an equation (3) below, in which 24 is the area of the predetermined region 500. Thus, the one dimensional sub-pixel rendering unit 320 thus generates the display pixel value R1 by using the weighted coefficients WR1 and the data values R, corresponding to the pixel 1220, 1228 and 1224, of the video signal VS.

$$WR3=[8\ 16\ 0]24 \tag{3}$$

Similarly, the one dimensional sub-pixel rendering unit 320 is able to determine the display pixel value R2 of the sub-pixel 122*b* of the pixel 1222 with similar operations, and the repetitious descriptions are not given here. The one dimensional sub-pixel rendering unit 320 finds that the weighted coefficients WR2 related to the sub-pixel 122*b* of the pixel 1222 can be determined as an equation (4) below, and the one dimensional sub-pixel rendering unit 320 thus generates the display pixel value R2 by using the weighted coefficients WR2 and the data values R, corresponding to the pixels at both sides of the pixel 1222, of the video signal VS.

$$WR4=[0\ 16\ 8]24 \tag{4}$$

As the operations illustrated in FIG. 4 are considered of rendering sub-pixels in two dimensions, the operations illustrated in FIG. 5 are only considered of rendering sub-pixels in one dimension. Thus, the operation speed of the operations of the one dimensional sub-pixel rendering unit 320 corresponding to FIG. 5 is faster than that of the operations of the two dimensional sub-pixel rendering unit 340 corresponding to FIG. 4. Further, the power consumed during the operations of the one dimensional sub-pixel rendering unit 320 is also lower than the power consumed during the operations of the two dimensional sub-pixel rendering unit 340. The battery power of the driving device 140 can be saved.

As a result, the driving device 140 can select different sub-pixel rendering methods under different usage scenarios. When the frame, such as the second frame 200B, is determined to be non-artificial, the one dimensional sub-pixel rendering unit 320 is used to obtain a faster processing speed and reduce the power consumption. When the frame, such as the second frame 200B, is determined to be artificial, the two dimensional sub-pixel rendering unit 340 is used to obtain a sharper edge and clearer display result of the frame. Both the efficiency and the quality of the display result can be taken into account.

Figure 6:
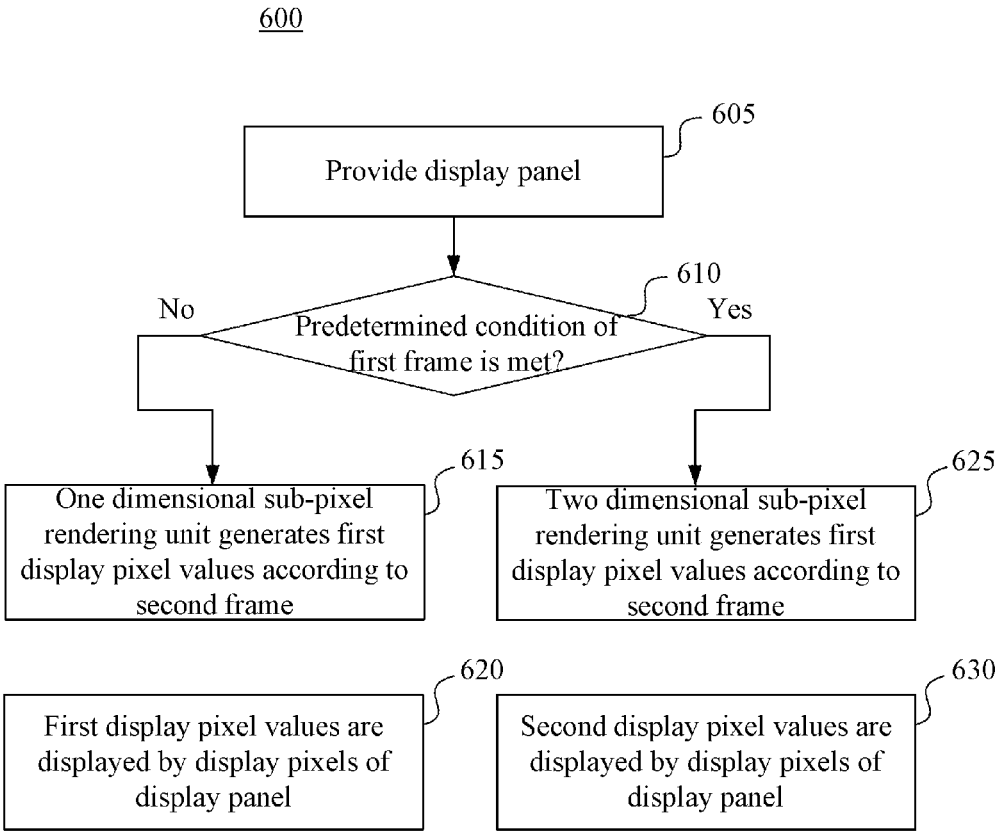
FIG. 6 is a flow chart of a driving method in accordance with various embodiments of the present disclosure.

Reference is now made to FIG. 6. FIG. 6 is a flow chart of a driving method 600 in accordance with various embodiments of the present disclosure. The driving method 600 can be used in the display system 100 illustrated in FIG. 1. The driving method 600 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 605, the display panel 120 as illustrated in FIG. 1 is provided.

In step 610, the first frame 200A is received from the video source VS and whether the predetermined condition of the first frame is met is determined.

In step 615, when the predetermined condition is not met, the second frame 200B having the data pixels from the video source is received by the one dimensional sub-pixel rendering unit 320 to generate the groups of first display pixel values 310. Further, in step 620, the groups of first display pixel values 310 are outputted to the display panel 120 and are displayed by the display pixels 122.

In step 625, when the predetermined condition is met, the second frame from the video source VS is received by the two dimensional sub-pixel rendering unit 340 to generate the groups of second display pixel values 330. Further, in step 630, the groups of the second display pixel values 330 are outputted to the display panel 120 and are displayed by the display pixels 122.

Figure 7:
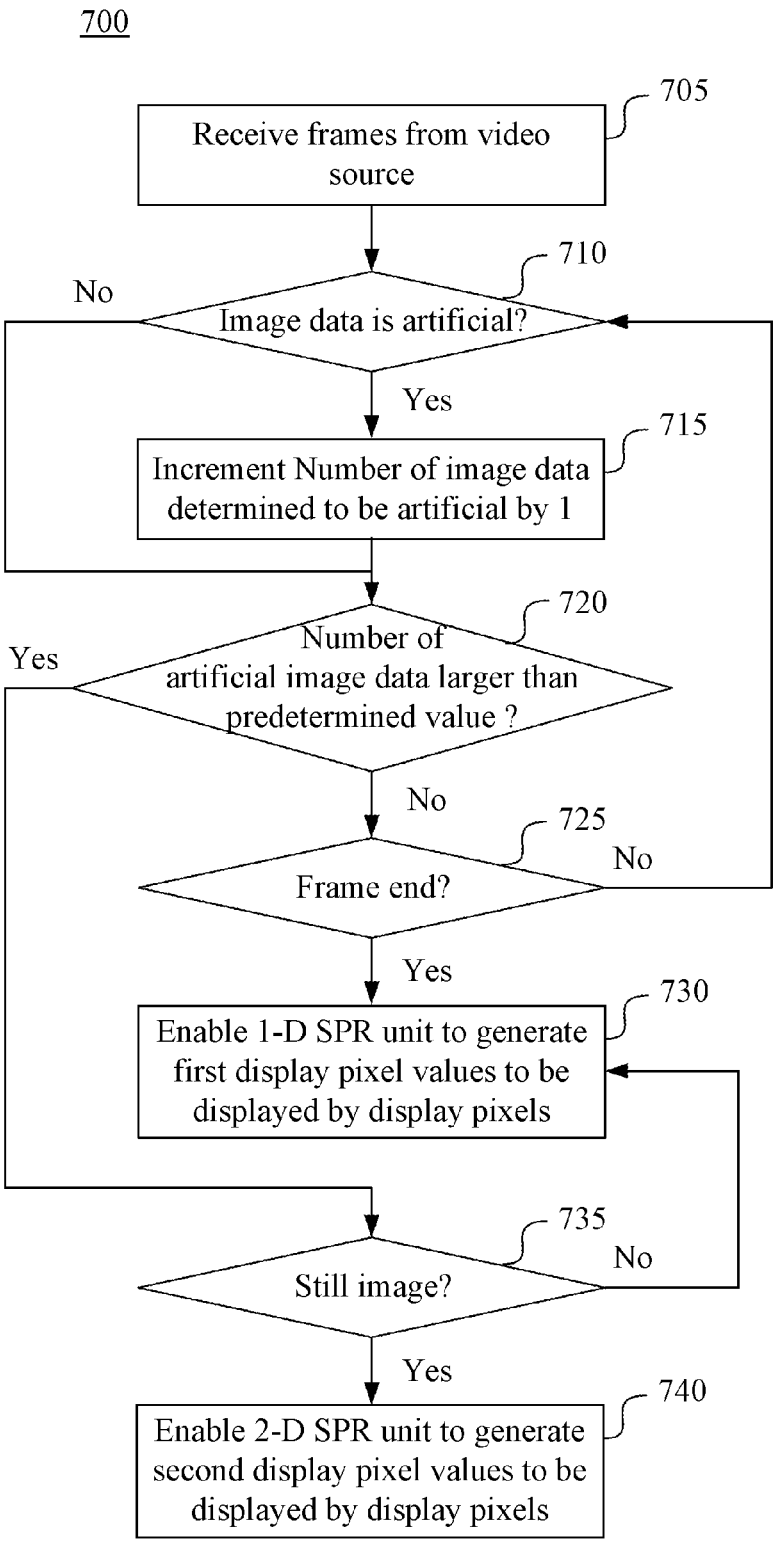
FIG. 7 is a detail flow chart of a driving method in accordance with various embodiments of the present disclosure.

Reference is now made to FIG. 7. FIG. 7 is a detail flow chart of a driving method 700 in accordance with various embodiments of the present disclosure. The driving method 700 can be used in the display system 100 illustrated in FIG. 1. The driving method 700 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 705, the frames are received from the video source VS.

In step 710, whether a piece of the image data of the first frame 200A is artificial is determined.

Further, in step 715, the number of the pieces of image data VDATA determined to be artificial is incremented by 1 when the piece of the image data of the first frame 200A is determined to be artificial and the flow proceeds to step 720. On the other hand, when the piece of the image data of the first frame 200A is determined to be non-artificial, the flow directly goes from step 710 to step 720.

In step 720, whether the number of the pieces of image data VDATA determined to be artificial is larger than a predetermined value is determined.

When the number is not larger than the predetermined value, whether the frame end is reached is determined in step 725. When the frame end is not reached, the flow goes back to step 710 to determine whether the next piece of image data is artificial or not.

On the other hand, when the frame end is reached, the flow proceeds to step 730 such that the one dimensional sub-pixel rendering unit 320 is enabled to generate groups of first display pixel values 310 to be displayed by the display panel 120 based on the second frame 200B.

When the number is larger than the predetermined value, the flow proceeds to step 735 to determine whether the second frame 200B is a still image.

When the second frame 200B is not a still image, the flow goes to step 730 such that the one dimensional sub-pixel rendering unit 320 is enabled to generate groups of first display pixel values 310 to be displayed by the display panel 120 based on the second frame 200B.

When the second frame 200B is a still image, the flow goes to step 740 such that the two dimensional sub-pixel rendering unit 340 is enabled to generate groups of second display pixel values 330 to be displayed by the display panel 120 based on the second frame 200B.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display system comprising:

a display panel having a plurality of display pixels arranged in display rows and display columns, each of the display pixels comprising two sub display pixels arranged along a row direction such that any consecutive three of the sub display pixels in either the row direction and a column direction display a combination of a first color, a second color and a third color;

a driving device comprising:

a mode detection circuit configured to receive a first image frame from a video source and to determine whether a predetermined condition of the first image frame is met;

a one dimensional (1-D) sub-pixel rendering circuit configured to receive a second image frame having a plurality of data pixels arranged in data rows and data columns from the video source and to generate a plurality groups of first display pixel values each generated for one target data pixel based on the data pixels neighboring the target data pixel within a same one of the data rows when the predetermined condition is not met; and a two dimensional (2-D) sub-pixel rendering circuit configured to receive the second image frame from the video source and to generate a plurality groups of second display pixel values each generated for one target data pixel based on surrounding data pixels in the neighboring data rows and the neighboring data columns when the predetermined condition is met;

wherein either the groups of the first display pixel values or the groups of the second display pixel values are generated to be outputted to the display panel and are displayed by the display pixels.

2. The display system of claim 1, wherein the first image frame comprises a plurality pieces of image data each comprising a group of color data values, and the predetermined condition comprises a first condition that a number of the pieces of image data determined to be artificial is larger than a predetermined value;

wherein one piece of the image data is determined to be artificial when all of a plurality of color differences between any two of the color data values of the piece of the image data is larger than or smaller than a predetermined range.

3. The display system of claim 1, wherein the predetermined condition further comprises a second condition that the first image frame is determined to be a still image frame.

4. The display system of claim 1, wherein the mode detection circuit is configured to disable the two dimensional sub-pixel rendering circuit when the predetermined condition is not met and is configured to disable the one dimensional sub-pixel rendering circuit when the predetermined condition is met.

5. The display system of claim 4, wherein the mode detection circuit is further configured to generate a mode selection signal to control the one dimensional sub-pixel rendering circuit and the two dimensional sub-pixel rendering circuit.

6. The display system of claim 1, further comprising a selection circuit, wherein the mode detection circuit is further configured to control the selection circuit to transmit the first display pixel values from the one dimensional sub-pixel rendering circuit to the display panel when the predetermined condition is not met, and to transmit the second display pixel values from the two dimensional sub-pixel rendering circuit to the display panel when the predetermined condition is met.

7. The display system of claim 1, wherein the second image frame is a frame subsequent to the first image frame.

8. The display system of claim 1, further comprising a memory to store frame data processed by the two dimensional sub-pixel rendering circuit.

9. A driving method used in a display system comprising:

providing a display panel having a plurality of display pixels arranged in display rows and display columns, each of the display pixels comprising two sub display pixels arranged along a row direction such that any consecutive three of the sub display pixels in either the row direction and a column direction display a combination of a first color, a second color and a third color;

receiving a first image frame from a video source and determining whether a predetermined condition of the first image frame is met;

receiving a second image frame having a plurality of data pixels arranged in data rows and data columns from the video source by a one dimensional sub-pixel rendering circuit to generate a plurality groups of first display pixel values each generated for one target data pixel based on the data pixels neighboring the target data pixel within a same one of the data rows when the predetermined condition is not met;

receiving the second image frame from the video source by a two dimensional sub-pixel rendering circuit to generate a plurality groups of second display pixel values each generated for one target data pixel based on surrounding data pixels in the neighboring data rows and the neighboring data columns when the predetermined condition is met; and generating and outputting either the groups of the first display pixel values or the groups of the second display pixel values to be displayed by the display pixels of the display panel.

10. The driving method of claim 9, wherein the first image frame comprises a plurality pieces of pixel data each comprising a group of color values, and the predetermined condition comprises a first condition that a number of the pieces of pixel data determined to be artificial is larger than a predetermined value;

wherein one piece of the pixel data is determined to be artificial when all of a plurality of color differences between any two of the color values of the piece of the pixel data is larger than or smaller than a predetermined range.

11. The driving method of claim 9, wherein the predetermined condition further comprises a second condition that the first image frame is determined to be a still image frame.

12. The driving method of claim 9, further comprising:

disabling the two dimensional sub-pixel rendering circuit when the predetermined condition is not met; and disabling the one dimensional sub-pixel rendering circuit when the predetermined condition is met.

13. The driving method of claim 12, further comprising:

controlling the one dimensional sub-pixel rendering circuit and the two dimensional sub-pixel rendering circuit by generating a mode selection signal thereto.

14. The driving method of claim 9, further comprising:

controlling a selection circuit to transmit the first display pixel values from the one dimensional sub-pixel rendering circuit to the display panel when the predetermined condition is not met; and controlling the selection circuit to transmit the second display pixel values from the two dimensional sub-pixel rendering circuit to the display panel when the predetermined condition is met.

15. The driving method of claim 9, wherein the second image frame is a frame subsequent to the first image frame.

16. The driving method of claim 9, further comprising:

storing frame data processed by the two dimensional sub-pixel rendering circuit in a memory.

* * * * *